US011118791B2

(12) United States Patent
Shirota

(10) Patent No.: US 11,118,791 B2
(45) Date of Patent: Sep. 14, 2021

(54) INDOOR UNIT OF AIR-CONDITIONING APPARATUS

(71) Applicant: Mitsubishi Electric Corporation, Tokyo (JP)

(72) Inventor: Mitsuhiro Shirota, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 33 days.

(21) Appl. No.: 16/470,959

(22) PCT Filed: Mar. 3, 2017

(86) PCT No.: PCT/JP2017/008533
§ 371 (c)(1),
(2) Date: Jun. 18, 2019

(87) PCT Pub. No.: WO2018/158940
PCT Pub. Date: Sep. 7, 2018

(65) Prior Publication Data

US 2020/0018493 A1 Jan. 16, 2020

(51) Int. Cl.
*F24F 1/0011* (2019.01)
*F24F 1/0073* (2019.01)
(Continued)

(52) U.S. Cl.
CPC ..... *F24F 1/0011* (2013.01); *F24F 1/0025* (2013.01); *F24F 1/0063* (2019.02);
(Continued)

(58) Field of Classification Search
CPC ..... F24F 1/0025; F24F 1/008; F24F 1/0011; F24F 1/0063; F24F 1/0073; F24F 1/0057;
(Continued)

(56) References Cited

U.S. PATENT DOCUMENTS 5,600,963 A * 2/1997 Koo ..... F24F 13/20 454/332
6,725,684 B2 * 4/2004 Lee ..... F24F 1/0007 62/298
(Continued)

FOREIGN PATENT DOCUMENTS

CN 1405504 A 3/2003
EP 1 271 065 A2 1/2003
(Continued)

OTHER PUBLICATIONS

Extended European Search Report dated Jan. 31, 2020 issued in corresponding European patent application No. 17898440.7.
(Continued)

*Primary Examiner* — Frantz F Jules
*Assistant Examiner* — Martha Tadesse
(74) *Attorney, Agent, or Firm* — Posz Law Group

(57) ABSTRACT

An indoor unit of an air-conditioning apparatus according to the present invention includes a casing having an air inlet provided at a top face, an air outlet provided at a lower portion, and an airflow passage through which the air inlet and the air outlet communicate with each other; a fan disposed in the casing; a heat exchanger disposed upstream of the fan in the casing; a first filter disposed upstream of the heat exchanger in the casing; a front panel attached at a front portion of the casing; a protrusion provided on a back face of the front panel; and a second filter disposed behind the front panel and between the protrusion and the heat exchanger, the second filter being separate from the first filter.

3 Claims, 4 Drawing Sheets

(51) Int. Cl.

| | |
|---|---|
| ***F24F 1/0063*** | (2019.01) |
| ***F24F 1/0025*** | (2019.01) |
| *F24F 13/20* | (2006.01) |
| *F24F 13/28* | (2006.01) |
| *F24F 13/30* | (2006.01) |

(52) U.S. Cl.
CPC ..... *F24F 1/0073* (2019.02); *F24F 13/20* (2013.01); *F24F 13/28* (2013.01); *F24F 13/30* (2013.01)

(58) Field of Classification Search
CPC .. F24F 13/30; F24F 13/20; F24F 13/28; F24F 1/0007
See application file for complete search history.

(56) References Cited

U.S. PATENT DOCUMENTS

| | | | | |
|---|---|---|---|---|
| 2002/0189274 | A1* | 12/2002 | Lee | F24F 1/0011 62/298 |
| 2007/0209373 | A1* | 9/2007 | Taira | F24F 1/0057 62/78 |
| 2010/0287973 | A1* | 11/2010 | Son | F24F 1/0057 62/407 |
| 2012/0111045 | A1 | 5/2012 | Ikeda et al. | |
| 2014/0102676 | A1* | 4/2014 | Tadokoro | F04D 29/4226 165/121 |
| 2015/0047815 | A1 | 2/2015 | Ikeda et al. | |

FOREIGN PATENT DOCUMENTS

| | | | | |
|---|---|---|---|---|
| EP | 1808645 | A2 | 7/2007 | |
| EP | 3 124 887 | A1 | 2/2017 | |
| JP | S61-135887 | U | 8/1986 | |
| JP | 2001-065903 | A | 3/2001 | |
| JP | 2001-263785 | A | 9/2001 | |
| JP | 2002-188851 | A | 7/2002 | |
| JP | 2004-101171 | A | 4/2004 | |
| JP | 2004-150738 | A | 5/2004 | |
| JP | 2005-195199 | A | 7/2005 | |
| JP | 2005-326137 | A | 11/2005 | |
| JP | 2006-090694 | A | 4/2006 | |
| JP | 2009-156558 | A | 7/2009 | |
| JP | 2009-216250 | A | 9/2009 | |
| JP | 2012-083071 | A | 4/2012 | |
| WO | 2011/016152 | A1 | 2/2011 | |
| WO | WO-2011016152 | A1 * | 2/2011 | F04D 29/4206 |
| WO | 2015/145726 | A1 | 10/2015 | |
| WO | WO-2015145726 | A1 * | 10/2015 | F24F 13/14 |

OTHER PUBLICATIONS

International Search Report of the International Searching Authority dated May 23, 2017 for the corresponding international application No. PCT/JP2017/008533 (and English translation).
Office Action dated Aug. 5, 2020 issued in corresponding CN patent application No. 201780087596.5 (and English translation).
Office Action dated Sep. 1, 2020 issued in corresponding JP patent application No. 2019-502411 (and English translation).
Office Action dated Jan. 20, 2021 issued in corresponding CN patent application No. 201780087596.5 (and English translation).
Office Action dated Feb. 19, 2021 issued in corresponding EP patent application No. 17898440.7.

* cited by examiner

INDOOR UNIT OF AIR-CONDITIONING APPARATUS

TECHNICAL FIELD

The present invention relates to an indoor unit of an air-conditioning apparatus including an air cleaning filter.

BACKGROUND ART

An example of an indoor unit of an air-conditioning apparatus according to the related art includes an air cleaning filter disposed between an air inlet and an indoor heat exchanger so that air that enters through the air inlet passes through the air cleaning filter and is cleaned (see, for example, Patent Literature 1).

The indoor unit of the air-conditioning apparatus described in Patent Literature 1 is configured such that accommodating portions (333b) that accommodate air cleaning filters (331) are disposed behind a front panel (25).

CITATION LIST

Patent Literature

Patent Literature 1: Japanese Unexamined Patent Application Publication No. 2009-216250

SUMMARY OF INVENTION

Technical Problem

The indoor unit of the air-conditioning apparatus described in Patent Literature 1 is configured such that the air cleaning filters, which have a high airflow passage resistance, are inclined. Since the air cleaning filters are disposed behind the front panel, the air cleaning filters impede the flow of air toward a lower section of the indoor heat exchanger. When the flow of air toward the lower section of the indoor heat exchanger is impeded, the amount of air that contributes to heat exchange in the indoor heat exchanger is reduced and the performance of the indoor heat exchanger is degraded.

Thus, an indoor unit of an air-conditioning apparatus including an air cleaning filter that is separate from a pre-filter is required to reduce degradation in the performance of an indoor heat exchanger and ensure sufficient air cleaning performance of the air cleaning filter at the same time.

The present invention has been made to overcome the above-described problem, and an object of the present invention is to provide an indoor unit of an air-conditioning apparatus that enables an air cleaning filter to provide an air cleaning effect with less degradation in the performance of a heat exchanger.

Solution to Problem

An indoor unit of an air-conditioning apparatus according to an embodiment of the present invention includes a casing having an air inlet provided at a top face of the casing, an air outlet provided at a lower portion of the casing, and an airflow passage through which the air inlet and the air outlet communicate with each other; a fan disposed in the casing; a heat exchanger disposed upstream in airflow of the fan in the casing; a first filter disposed upstream in airflow of the heat exchanger in the casing; a front panel attached at a front portion of the casing; a protrusion provided at a back face of the front panel; and a second filter disposed behind the front panel and between the protrusion and the heat exchanger, the second filter being separate from the first filter.

Advantageous Effects of Invention

The indoor unit of the air-conditioning apparatus according to the embodiment of the present invention is configured such that the protrusion is provided on the back face of the front panel and that the second filter is disposed between the protrusion and the heat exchanger. Accordingly, a flow of air directed from the front panel to the air cleaning filter can be generated by the protrusion, so that the air cleaning effect can be obtained with less degradation in the performance of the heat exchanger.

DESCRIPTION OF EMBODIMENTS

Figure 1:
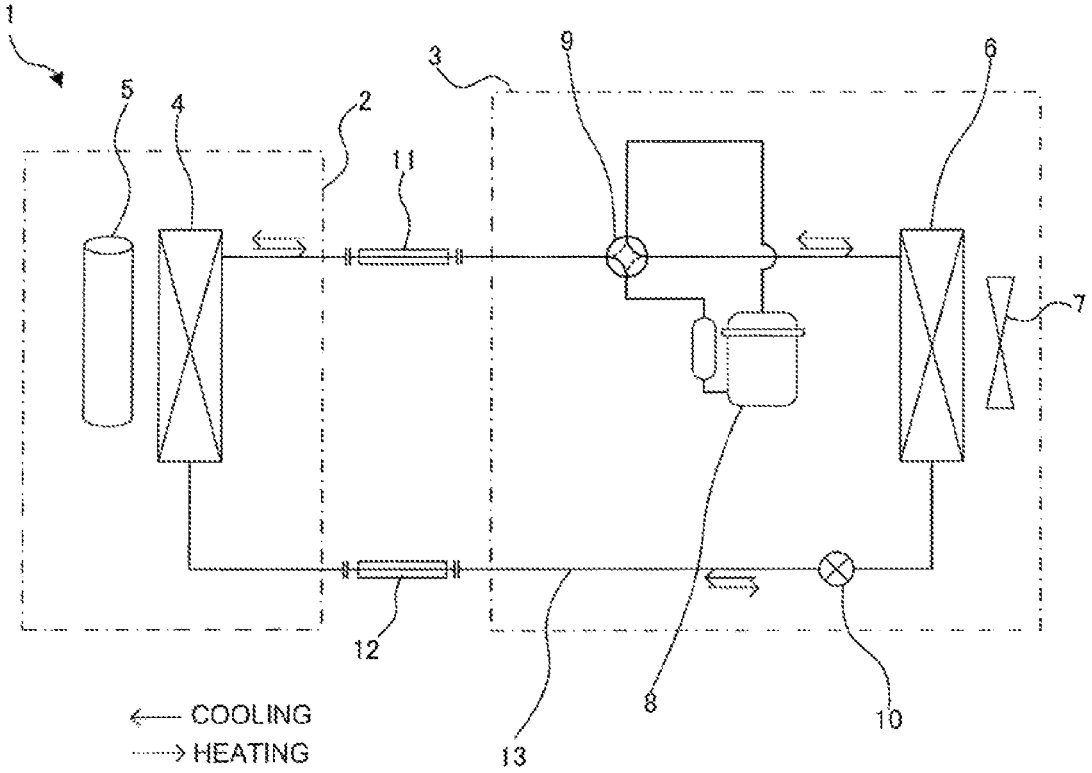
FIG. 1 is a schematic diagram illustrating an example of a refrigerant circuit structure of an air-conditioning apparatus including an indoor unit according to Embodiment of the present invention.

Embodiment of the present invention will now be described with reference to the drawings. FIG. 1 and other drawings do not necessarily depict the actual relative sizes of the components. In addition, elements denoted by the same reference signs are the same or corresponding elements in FIG. 1 and other figures. This applies throughout the entire specification. In addition, the configurations of the constituent elements described in the full text of the specification are merely examples, and are not limited to the description.

Embodiment

FIG. 1 is a schematic diagram illustrating an example of a refrigerant circuit structure of an air-conditioning apparatus 1 including an indoor unit 2 according to Embodiment of the present invention. In FIG. 1, the solid line arrows indicate the flow of refrigerant in a cooling operation, and the broken line arrows indicate the flow of refrigerant in a heating operation.

<Structure of Air-Conditioning Apparatus 1>

As illustrated in FIG. 1, the air-conditioning apparatus 1 includes the indoor unit 2 and an outdoor unit 3.

The indoor unit 2 includes an indoor heat exchanger 4 and an indoor fan 5.

The outdoor unit 3 includes an outdoor heat exchanger 6, an outdoor fan 7, a compressor 8, a four-way valve 9, and an expansion valve 10.

A refrigerant circuit 13 is formed by connecting the indoor unit 2 and the outdoor unit 3 to each other with a gas-side connection pipe 11 and a liquid-side connection pipe 12.

The operation of the air-conditioning apparatus 1 can be switched between a cooling operation and a heating operation by switching the paths formed by the four-way valve 9. The air-conditioning apparatus 1 performs the cooling operation when the paths formed by the four-way valve 9 are as indicated by the solid lines in FIG. 1. The air-conditioning apparatus 1 performs the heating operation when the paths formed by the four-way valve 9 are as indicated by the broken lines in FIG. 1.

(Indoor Unit 2)

The indoor unit 2 is disposed in a space by which it can supply cooling energy or heating energy to the space or an air-conditioning target space (for example, an air-conditioning target space such as an indoor space, or another space connected to the air-conditioning target space by a duct or the like). The indoor unit 2 has a function of cooling or heating the air-conditioning target space by using cooling energy or heating energy supplied by the outdoor unit 3.

The indoor heat exchanger 4 functions as a condenser in the heating operation and as an evaporator in the cooling operation. The indoor heat exchanger 4 may be composed of, for example, a fin-and-tube heat exchanger.

The indoor heat exchanger 4 corresponds to a "heat exchanger" according to the present invention.

The indoor fan 5 is arranged to be surrounded by the indoor heat exchanger 4 (see FIG. 6), and supplies air, which serves as heat exchange fluid, to the indoor heat exchanger 4. The indoor fan 5 may be composed of, for example, a cross-flow fan.

The indoor fan 5 corresponds to a "fan" according to the present invention.

(Outdoor Unit 3)

The outdoor unit 3 is disposed in a space other than the air-conditioning target space (for example, an outdoor space), and has a function of supplying cooling energy or heating energy to the indoor unit 2.

The outdoor heat exchanger 6 functions as an evaporator in the heating operation and as a condenser in the cooling operation.

The outdoor fan 7 supplies air, which serves as heat exchange fluid, to the outdoor heat exchanger 6. The outdoor fan 7 may be composed of, for example, a propeller fan having a plurality of blades.

The compressor 8 compresses refrigerant and discharges the compressed refrigerant. The compressor 8 may be composed of, for example, a rotary compressor or a scroll compressor. When the outdoor heat exchanger 6 functions as a condenser, the refrigerant discharged from the compressor 8 flows into the outdoor heat exchanger 6 through a refrigerant pipe. When the outdoor heat exchanger 6 functions as an evaporator, the refrigerant discharged from the compressor 8 passes through the indoor unit 2 and then flows into the outdoor heat exchanger 6 through a refrigerant pipe.

The four-way valve 9 is connected to a discharge side of the compressor 8 and switches the flow of the refrigerant between that for the heating operation and that for the cooling operation. A combination of two-way valves or a combination of three-way valves may be provided instead of the four-way valve 9.

The expansion valve 10 expands the refrigerant that has passed through the indoor heat exchanger 4 or the outdoor heat exchanger 6, thereby reducing the pressure of the refrigerant. The expansion valve 10 may be composed of, for example, an electric expansion valve capable of adjusting the flow rate of the refrigerant. The expansion valve 10 may be included in the indoor unit 2 instead of the outdoor unit 3.

The refrigerant circuit 13 is formed by connecting the compressor 8, the indoor heat exchanger 4, the expansion valve 10, and the outdoor heat exchanger 6 with refrigerant pipes including the gas-side connection pipe 11 and the liquid-side connection pipe 12.

The four-way valve 9 may be omitted so that the direction in which the refrigerant flows through the refrigerant circuit 13 is constant.

<Operation of Air-Conditioning Apparatus 1>

The operation of the air-conditioning apparatus 1 will be described together with the flow of the refrigerant. The operation of the air-conditioning apparatus 1 described below is an example in which the heat exchange fluid is air and fluid that exchanges heat with the heat exchange fluid is refrigerant.

The cooling operation performed by the air-conditioning apparatus 1 will now be described.

When the compressor 8 is activated, high-temperature high-pressure refrigerant in a gas state is discharged from the compressor 8. After that, the refrigerant flows as indicated by the solid line arrows. The high-temperature high-pressure gas refrigerant (single phase) discharged from the compressor 8 passes through the four-way valve 9 and flows into the outdoor heat exchanger 6, which functions as a condenser. The high-temperature high-pressure gas refrigerant that has flowed into the outdoor heat exchanger 6 exchanges heat with air supplied by the outdoor fan 7, so that the high-temperature high-pressure gas refrigerant is condensed into high-pressure liquid refrigerant (single phase).

The high-pressure liquid refrigerant flowing out of the outdoor heat exchanger 6 flows into the expansion valve 10, and is expanded by the expansion valve 10 to thereby change into two-phase refrigerant including low-pressure gas refrigerant and liquid refrigerant. The two-phase refrigerant flows into the indoor heat exchanger 4, which functions as an evaporator. The two-phase refrigerant that has flowed into the indoor heat exchanger 4 exchanges heat with air supplied by the indoor fan 5, so that the liquid refrigerant included in the two-phase refrigerant is evaporated and thus the two-phase refrigerant turns into low-pressure gas refrigerant (single phase). As a result of this heat exchange, the air-conditioning target space is cooled. The low-pressure gas refrigerant flowing out of the indoor heat exchanger 4 passes through the four-way valve 9 and flows into the compressor 8, where the refrigerant is compressed into high-temperature high-pressure gas refrigerant, and discharged from the compressor 8 again. The above-described cycle is repeated.

The heating operation performed by the air-conditioning apparatus 1 will now be described.

When the compressor 8 is activated, high-temperature high-pressure refrigerant in a gas state is discharged from the compressor 8. After that, the refrigerant flows as indicated by the broken line arrows. The high-temperature high-pressure gas refrigerant (single phase) discharged from the compressor 8 passes through the four-way valve 9 and flows into the indoor heat exchanger 4, which functions as a condenser. The high-temperature high-pressure gas refrigerant that has flowed into the indoor heat exchanger 4 exchanges heat with air supplied by the indoor fan 5, so that the high-temperature high-pressure gas refrigerant is condensed into high-pressure liquid refrigerant (single phase). As a result of this heat exchange, the air-conditioning target space is heated.

The high-pressure liquid refrigerant flowing out of the indoor heat exchanger 4 flows into the expansion valve 10, and is expanded by the expansion valve 10 to thereby change into two-phase refrigerant including low-pressure gas refrigerant and liquid refrigerant. The two-phase refrigerant flows into the outdoor heat exchanger 6, which functions as an evaporator. The two-phase refrigerant that has flowed into the outdoor heat exchanger 6 exchanges heat with air supplied by the outdoor fan 7, so that the liquid refrigerant included in the two-phase refrigerant is evaporated and thus the two-phase refrigerant turns into low-pressure gas refrigerant (single phase). The low-pressure gas refrigerant flowing out of the outdoor heat exchanger 6 passes through the four-way valve 9 and flows into the compressor 8, where the refrigerant is compressed into high-temperature high-pressure gas refrigerant, and is discharged from the compressor 8 again. The above-described cycle is repeated.

<Details of Indoor Unit 2>

The indoor unit 2 will now be described in detail.

Figure 2:
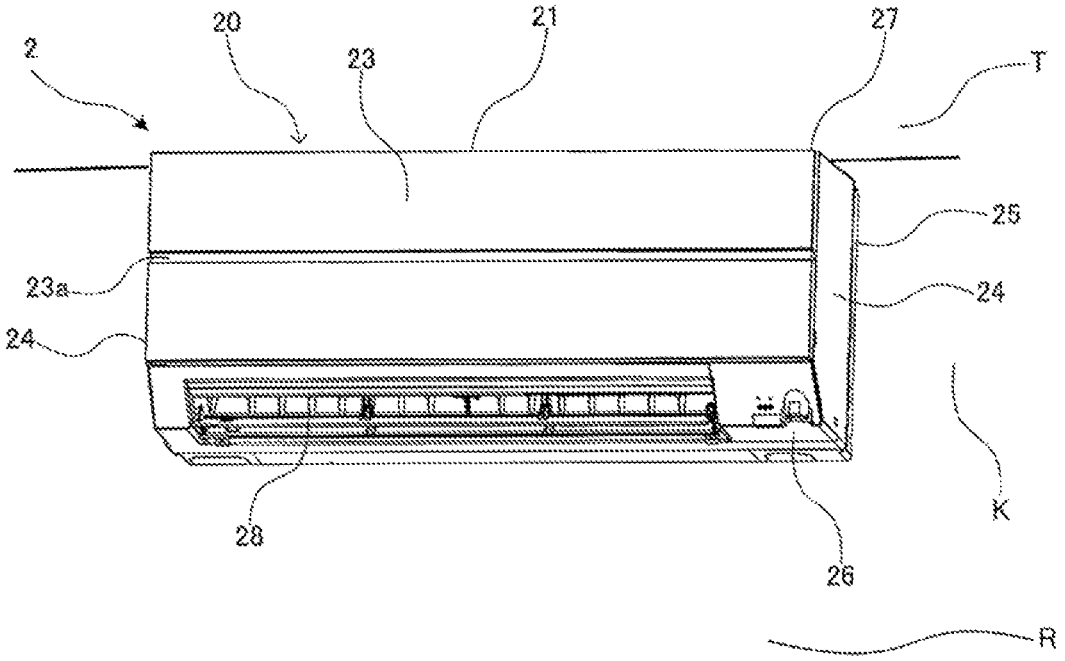
FIG. 2 is a schematic perspective view of the indoor unit according to Embodiment of the present invention.
Figure 3:
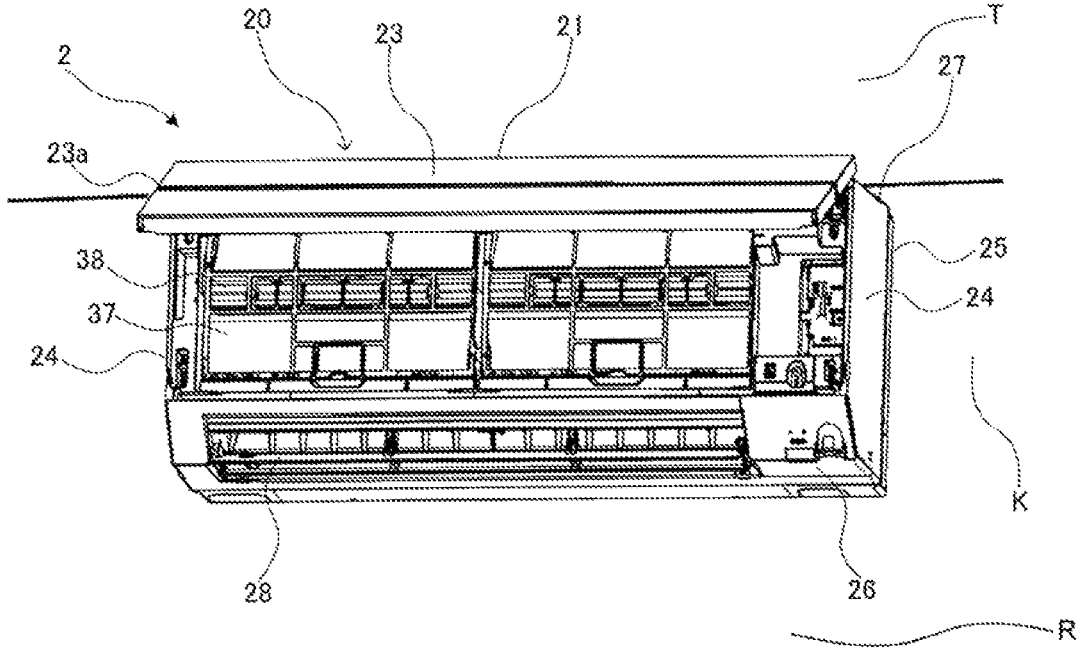
FIG. 3 is a schematic perspective view of the indoor unit according to Embodiment of the present invention when a front panel is open.

FIG. 2 is a schematic perspective view of the indoor unit 2. FIG. 3 is a schematic perspective view of the indoor unit 2 when a front panel 23 is open. The indoor unit 2 will be described in detail with reference to FIG. 2 and FIG. 3.

In FIGS. 2 and 3, a face of the indoor unit 2 facing a wall face K is defined as a back face, and a face opposite to the back face is defined as a front face. A face of the indoor unit 2 facing a ceiling T is defined as a top face, and a face opposite to the top face is defined as a bottom face. A side face of the indoor unit 2 at the right side in FIG. 2 is defined as a right side face, and a face opposite to the right side face is defined as a left side face. Components included in the indoor unit 2 will be described based on similar definitions of positional relationships.

As illustrated in FIG. 2, the indoor unit 2 is mounted on, for example, the wall face K of a room R that is an air-conditioning target space. The room R includes a space surrounded by the ceiling T and the wall face K. The indoor unit 2 is mounted such that the back face thereof is fixed to the wall face K and the top face thereof is near the ceiling T.

As illustrated in FIG. 2, the indoor unit 2 includes a casing 20 having a horizontally elongated cuboid shape. However, the shape of the casing 20 is not limited to a horizontally elongated cuboid shape.

The casing 20 has an open front side, which is covered by a front panel 23. The left and right sides of the casing 20 are covered by side panels 24. The back face of the casing 20 is covered by a back panel 25. The bottom face of the casing 20 is covered by the back panel 25, a bottom panel 26, and vertical flow directing plates 28. The top face of the casing 20 is covered by a top panel 27.

The top panel 27 has a grid-shaped opening, which functions as an air inlet 21. Thus, the air inlet 21 is formed solely at the top side of the indoor unit 2, and is not visible when viewed from the front.

The front panel 23 constitutes a design face at the front side of the indoor unit 2. The front panel 23 has a recess 23*a* that extends in a width direction of the casing 20 at the center in a height direction of the front panel 23. The front panel 23 is capable of covering and exposing the front side of the casing 20.

As illustrated in FIGS. 2 and 3, the casing 20 has an opening in a region covered by the vertical flow directing plates 28, and this opening serves as an air outlet 22. More specifically, the air outlet 22 is formed at a bottom portion of the casing 20 including the front and bottom sides.

A pre-filter 37 and an air cleaning filter 38 are disposed in the casing 20. The pre-filter 37 collects large particles of dust contained in air that enters through the air inlet 21. The air cleaning filter 38 collects small particles of dust contained in air that enters through the air inlet 21.

The pre-filter 37 corresponds to a "first filter" according to the present invention. The air cleaning filter 38 corresponds to a "second filter" according to the present invention.

Figure 4:
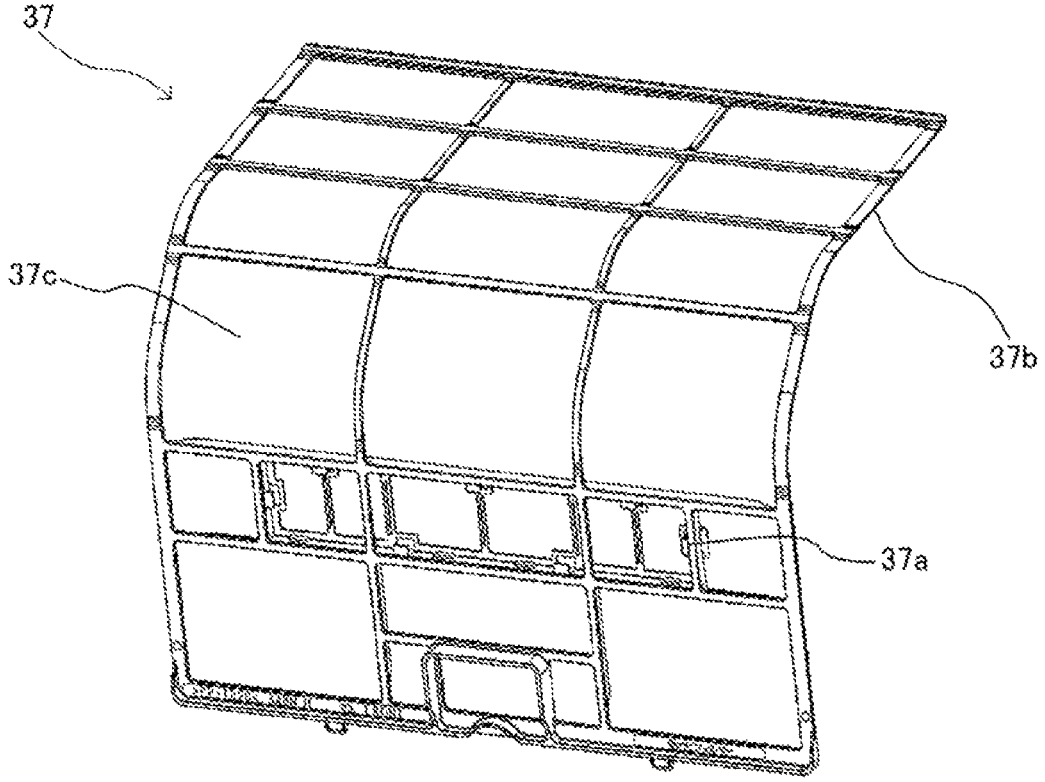
FIG. 4 is a schematic perspective view illustrating an exemplary structure of a pre-filter installed in the indoor unit according to Embodiment of the present invention.
Figure 5:
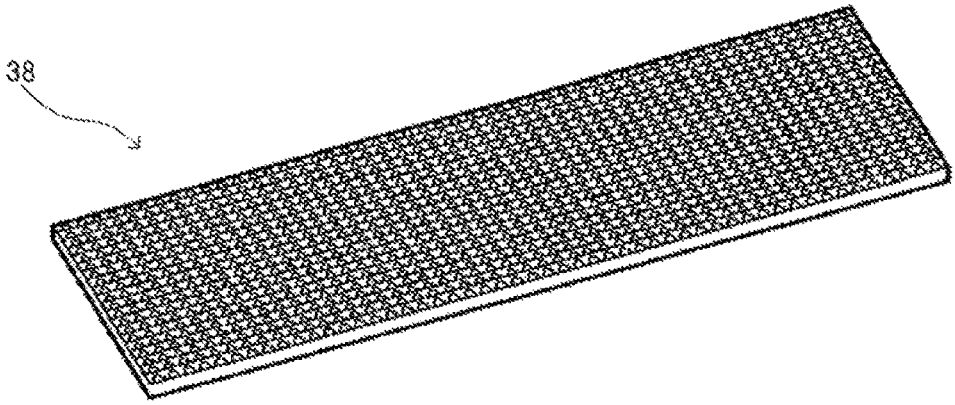
FIG. 5 is a schematic perspective view illustrating an exemplary structure of an air cleaning filter installed in the indoor unit according to Embodiment of the present invention.
Figure 6:
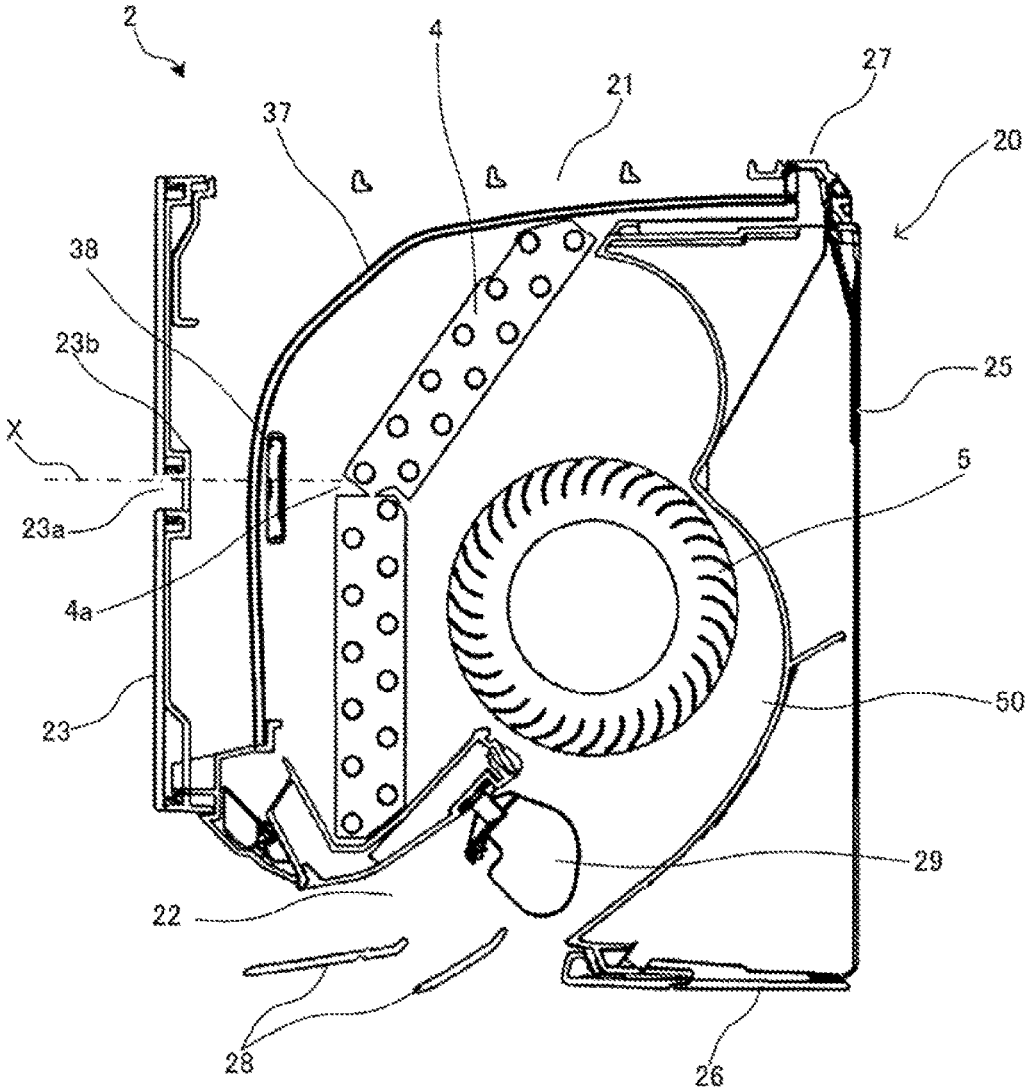
FIG. 6 is a schematic diagram illustrating an exemplary internal structure of the indoor unit according to Embodiment of the present invention.

FIG. 4 is a schematic perspective view illustrating an exemplary structure of the pre-filter 37 installed in the indoor unit 2. FIG. 5 is a schematic perspective view illustrating an exemplary structure of the air cleaning filter 38 installed in the indoor unit 2. FIG. 6 is a schematic diagram illustrating an exemplary internal structure of the indoor unit 2. The pre-filter 37 and the air cleaning filter 38 will be described with reference to FIGS. 4 to 6.

The pre-filter 37 is removably attachable to the casing 20 at a location upstream of the indoor heat exchanger 4. The pre-filter 37 includes a partially bent grid-shaped frame portion 37*b* and a filter portion 37*c* attached to the frame portion 37*b*. When the pre-filter 37 is installed in the indoor unit 2, as illustrated in FIG. 6, the pre-filter 37 is located near the front and top sides of the casing 20. The frame portion 37*b* is partially bent so that the pre-filter 37 can be easily attached to the casing 20.

A part of the frame portion 37*b* of the pre-filter 37 serves as an attachment portion 37*a* to which the air cleaning filter 38 is attached.

The air cleaning filter 38 has a greater airflow passage resistance against the flow of air than that of the pre-filter 37. The air cleaning filter 38 has, for example, a cuboid shape. The air cleaning filter 38 is formed separately from the pre-filter 37, and is removably retained by the attachment portion 37*a* of the pre-filter 37. Therefore, the air cleaning filter 38 can be installed in the casing 20 without using a special component. In addition, the air cleaning filter 38 can be installed in the casing 20 simply by attaching the air cleaning filter 38 to the attachment portion 37*a*, which is provided on a portion of the pre-filter 37. Thus, the air cleaning filter 38 can be easily installed and retained in the casing 20.

The air cleaning filter 38 may have, for example, a honeycomb structure of an electrostatically charged material. Alternatively, the air cleaning filter 38 may have, for example, a pleated multilayer structure having multiple layers of an electrostatically charged material. When the air cleaning filter 38 has such a structure, small particles of dust contained in air that passes through the air cleaning filter 38 can be electrostatically attracted by the air cleaning filter 38.

The material that forms the air cleaning filter 38, for example, a ceramic material, may have a catalyst deposited thereon so that the air cleaning filter 38 additionally provides a deodorizing effect. Also, the material that forms the air cleaning filter 38, for example, a ceramic material, may additionally contain an antibacterial component so that the air cleaning filter 38 additionally provides an antibacterial effect. These effects may be selectively provided depending on needs. The material, size, shape, etc., of the air cleaning filter 38 are not particularly limited, and may be determined as necessary in accordance with the structure of the indoor unit 2.

As illustrated in FIG. 6, an airflow passage 50, through which the air inlet 21 and the air outlet 22 communicate, is formed in the casing 20.

The vertical flow directing plates 28 are disposed in the air outlet 22. Also, horizontal flow directing plates 29 are disposed in the airflow passage 50 in the region between the indoor fan 5 and the air outlet 22.

The vertical flow directing plates 28 adjust the direction in which air is blown from the air outlet 22 in the vertical direction. When the operation is stopped, the vertical flow directing plates 28 cover the air outlet 22 and form a design face at the bottom of the indoor unit 2.

The horizontal flow directing plates 29 are disposed upstream of the vertical flow directing plates 28, and adjust the blowing direction of the air from the air outlet 22 in a horizontal direction.

As illustrated in FIG. 6, the indoor fan 5 and the indoor heat exchanger 4 are also disposed in the casing 20. The indoor heat exchanger 4 is disposed upstream of the indoor fan 5 along the airflow passage 50. The indoor fan 5 is driven by a motor (not shown) and generates a flow of air along the airflow passage 50. The indoor fan 5 is disposed downstream of the indoor heat exchanger 4 along the airflow passage 50. More specifically, the indoor heat exchanger 4 is disposed around the indoor fan 5, that is, upstream of the indoor fan 5, and causes heat exchange between the refrigerant that circulates through the refrigerant circuit 13 and indoor air supplied by the indoor fan 5.

The indoor heat exchanger 4 includes a bend portion 4*a* that is provided at a certain position in the height direction of the indoor heat exchanger 4 and at which the indoor heat exchanger 4 is bent and divided into two portions, which are upper and lower portions. The indoor heat exchanger 4 may have a plurality of the bend portions 4*a* at a plurality of positions. More specifically, one or more bend portions 4*a* may be provided in accordance with the arrangement, size, etc., of the indoor heat exchanger 4 in the casing 20.

The pre-filter 37 is disposed upstream of the indoor heat exchanger 4 in the casing 20, and the air cleaning filter 38 is attached to the pre-filter 37.

A protrusion 23*b* that projects toward the airflow passage 50 is formed on an inner face of the casing 20 that corresponds to the recess 23*a* in the front panel 23, that is, on the back face of the front panel 23.

The recess 23*a* and the protrusion 23*b* may be formed by, for example, pressing the front panel 23 from the outside toward the inside. In this case, the recess 23*a* and the protrusion 23*b* can be integrally formed together on the front panel 23, and formation of the protrusion 23*b* can be facilitated. However, the protrusion 23*b* may instead be formed on the back face of the front panel 23 without forming the recess 23*a* in the front panel 23. In such a case, the protrusion 23*b* may be formed by causing a portion of the back face of the front panel 23 to project toward the inside of the casing 20. Alternatively, the protrusion 23*b* may be formed as a separate component and attached to the back face of the front panel 23.

The protrusion 23*b* may be formed to extend over the entire width of the front panel 23, but is not limited to this. As described below, the protrusion 23*b* generates a flow of air toward the air cleaning filter 38. Accordingly, the length of the protrusion 23*b* is not limited as long as it corresponds to the dimension of the air cleaning filter 38 in the width direction. The cross sectional shape of the protrusion 23*b* is not limited to the rectangular shape illustrated in FIG. 6, and may instead be, for example, a triangle, a polygon having five of more vertices, or a smooth shape having a curved face that follows the flow of air.

When the casing 20 is covered by the front panel 23, the protrusion 23*b*, the air cleaning filter 38, and the bend portion 4*a* are roughly arranged along a straight line in the direction from the front panel 23 to the indoor fan 5. More specifically, the protrusion 23*b*, the air cleaning filter 38, and the bend portion 4*a* align along line X in FIG. 6. In other words, when the indoor unit 2 is viewed from the front, the protrusion 23*b*, the air cleaning filter 38, and the bend portion 4*a* are located on a projection of the recess 23*a* in a horizontal direction. The line X is a straight line that extends in the horizontal direction against the indoor unit 2 mounted on the wall face K. When a plurality of the bend portions 4*a* are provided at a plurality of positions, one of the bend portions 4*a*, the protrusion 23*b*, and the air cleaning filter 38 may be roughly align along a straight line.

Figure 7:
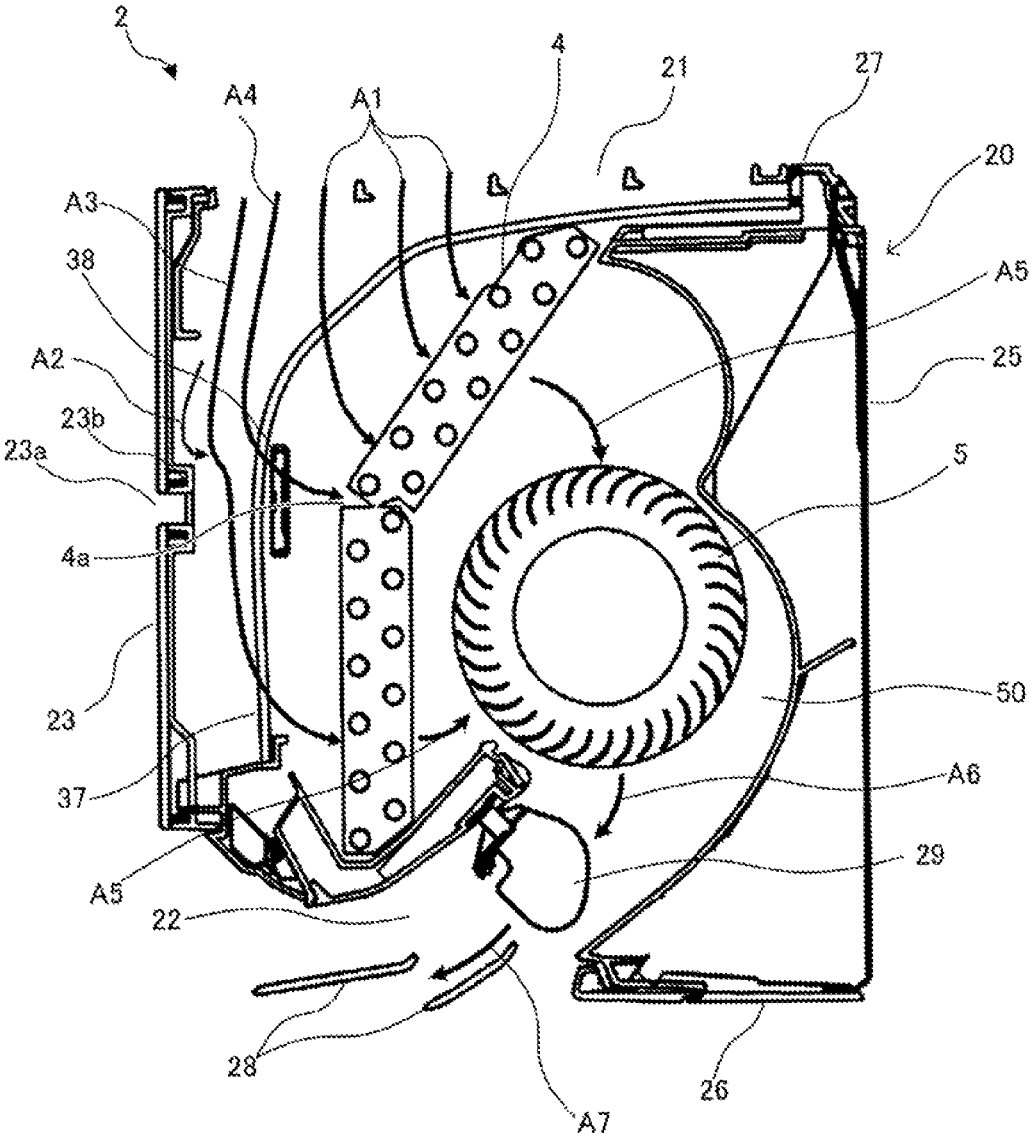
FIG. 7 is a schematic diagram illustrating the manner in which air flows in the indoor unit according to Embodiment of the present invention.

FIG. 7 is a schematic diagram illustrating the manner in which air flows through the indoor unit 2. The flow of air through the indoor unit 2 will be described with reference to FIG. 7.

In FIG. 7, arrows A1 to A7 indicate the flow of air in the casing 20. Among these arrows, the arrows A1 to A4 indicate the flow of air in a region around the air inlet 21 in the casing 20.

When the indoor fan 5 is activated, air is sucked into the casing 20 through the air inlet 21.

A part of the air that has been sucked into the casing 20 through the air inlet 21 is supplied to an upper portion of the indoor heat exchanger 4 (arrows A1). The upper portion of the indoor heat exchanger 4 is a portion of the indoor heat exchanger 4 disposed above the bend portion 4*a* in FIG. 7.

Another part of the air that has been sucked into the casing 20 through the air inlet 21 flows along the inner side of the front panel 23, comes into contact with the protrusion 23*b*, and is directed toward the indoor heat exchanger 4 (arrow A2).

Another part of the air that has been sucked into the casing 20 through the air inlet 21 passes through the region between the inner side of the front panel 23 and the air cleaning filter 38, and is supplied to a lower portion of the indoor heat exchanger 4 (arrow A3). The lower portion of the indoor heat exchanger 4 is a portion of the indoor heat exchanger 4 below the bend portion 4*a* in FIG. 7.

Another part of the air that has been sucked into the casing 20 through the air inlet 21 passes through the region between the inner side of the front panel 23 and the air cleaning filter 38 and then through the air cleaning filter 38, and flows toward the indoor heat exchanger 4 (arrow A4).

Referring to the arrow A4, the air that passes through the region between the inner side of the front panel 23 and the air cleaning filter 38 is caused to flow through the air cleaning filter 38 by the flow of air indicated by the arrow A2. The air that has passed through the air cleaning filter 38 flows toward the indoor heat exchanger 4.

Also, referring to the arrow A3, the air that passes through the region between the inner side of the front panel 23 and the air cleaning filter 38 is directed toward the indoor heat exchanger 4 by the flow of air indicated by the arrow A2 when passing through the region between the inner side of the front panel 23 and the air cleaning filter 38, but flows toward the lower portion of the indoor heat exchanger 4 without passing through the air cleaning filter 38.

The air supplied to the indoor heat exchanger 4 passes through the indoor heat exchanger 4 while exchanging heat with the refrigerant that flows through the indoor heat exchanger 4. Thus, the air is cooled in the cooling operation and heated in the heating operation, and then reaches the indoor fan 5 (arrows A5). The air that has passed through the indoor fan 5 or the gap between the indoor fan 5 and the back panel 25 (arrow A6) is blown forward or downward from the air outlet 22 (arrow A7).

As illustrated in FIG. 7, the air cleaning filter 38 is oriented to extend in the direction of the flow of air that has entered through the air inlet 21. More specifically, the air cleaning filter 38 is retained by the pre-filter 37 such that an air-receiving face of the air cleaning filter 38 extends in the vertical direction. Therefore, when the protrusion 23*b* is not provided, very little air passes through the air cleaning filter 38 having a high air resistance. In other words, the air that has been sucked in flows along the face of the air cleaning filter 38. Although the flow of air is not impeded and the performance of the indoor heat exchanger 4 is not degraded since air does not pass through the air cleaning filter 38, the air cleaning effect cannot be provided.

Since the protrusion 23*b* is provided on the back face of the front panel 23 of the indoor unit 2, the flow of air toward the inside of the indoor unit 2 (arrow A2) is generated by the protrusion 23*b*. In other words, the protrusion 23*b* enables a part of the air to pass through the air cleaning filter 38 without greatly impeding the flow in the casing 20. Thus, the indoor unit 2 enables the air cleaning filter 38 to provide the air cleaning effect with less degradation in the performance of the indoor heat exchanger 4.

The bend portion 4*a* of the indoor heat exchanger 4 is disposed downstream of the air cleaning filter 38. As is clear from FIG. 7, the air resistance of the bend portion 4*a* is less than that of the main portion of the indoor heat exchanger 4. Therefore, when the protrusion 23*b* is provided, the amount of air that flows can be increased. More specifically, although the air cleaning filter 38 has a high air resistance, the bend portion 4*a* disposed downstream thereof has a low air resistance, so that air easily flows toward the air cleaning filter 38 and that the air cleaning effect can be increased.

As described above, the indoor unit 2 includes the casing 20 having the air inlet 21 in the top face, the air outlet 22 in the lower portion, and the airflow passage 50 through which the air inlet 21 and the air outlet 22 communicate; the indoor heat exchanger 4 disposed in the casing 20; the indoor fan 5 disposed downstream of the indoor heat exchanger 4 in the casing 20; the front panel 23 that covers the front side of the casing 20; the protrusion 23*b* provided on the back face of the front panel 23; and the air cleaning filter 38 disposed between the protrusion 23*b* and the indoor heat exchanger 4 in the casing 20.

Thus, according to the indoor unit 2, a flow of air directed from the front panel 23 to the air cleaning filter 38 can be generated by the protrusion 23*b*, so that the air cleaning effect can be obtained with less degradation in the performance of the indoor heat exchanger 4.

The indoor unit 2 is configured such that the indoor heat exchanger 4 includes the bend portion 4*a* that is provided at a certain position in the height direction and at which the indoor heat exchanger 4 is bent, and such that the protrusion 23*b*, the air cleaning filter 38, and the bend portion 4*a* of the indoor heat exchanger 4 align in side view, for example, along a horizontal straight line in side view.

Thus, according to the indoor unit 2, the bend portion 4*a*, which has a lower air resistance than does the main portion of the indoor heat exchanger 4, is disposed downstream of the air cleaning filter 38, so that the amount of air that flows toward the air cleaning filter 38 can be increased.

In addition, the indoor unit 2 is configured such that the pre-filter 37 is disposed upstream of the indoor heat exchanger 4, and the air cleaning filter 38 is retained by a portion of the pre-filter 37 such that the air-receiving face thereof extends in the vertical direction.

Therefore, according to the indoor unit 2, the air cleaning filter 38 can be easily installed and retained in the casing 20 without using a special component.

In addition, according to the indoor unit 2, the protrusion 23*b* is formed integrally with the recess 23*a* formed in a portion of the front panel 23. Therefore, the protrusion 23*b* can be easily formed.

REFERENCE SIGNS LIST

1 air-conditioning apparatus 2 indoor unit 3 outdoor unit 4 indoor heat exchanger 4*a* bend portion 5 indoor fan 6 outdoor heat exchanger 7 outdoor fan 8 compressor 9 four-way valve 10 expansion valve 11 gas-side connection pipe 12 liquid-side connection pipe 13 refrigerant circuit 20 casing 21 air inlet 22 air outlet 23 front panel 23*a* recess 23*b* protrusion 24 side panel 25 back panel 26 bottom panel 27 top panel 28 vertical flow directing plate 29 horizontal flow directing plate 37 pre-filter 37*a* attachment portion 37*b* frame portion 37*c* filter portion 38 air cleaning filter 50 airflow passage A1 flow of air A2 flow of air A3 flow of air A4 flow of air A5 flow of air A6 flow of air A7 flow of air K wall face R room T ceiling

The invention claimed is:

1. An indoor unit of an air-conditioning apparatus comprising:

a casing having an air inlet provided solely at a top face of the casing, an air outlet provided at a lower portion of the casing, and an airflow passage through which the air inlet and the air outlet communicate with each other;

a fan disposed in the casing;

a heat exchanger disposed upstream in airflow of the fan in the casing;

a first filter disposed upstream in airflow of the heat exchanger in the casing;

a front panel attached at a front portion of the casing;

a protrusion provided at a back face of the front panel; and a second filter disposed behind the front panel and between the protrusion and the heat exchanger, the second filter being separate from the first filter, wherein the heat exchanger includes a bend portion at which the heat exchanger is bent at a certain position in a height direction, and the protrusion, the second filter, and the bend portion align along a single horizontal line in a side view.

2. The indoor unit of the air-conditioning apparatus of claim 1, wherein the second filter is retained by a portion of the first filter such that an air-receiving face thereof extends in a vertical direction.

3. The indoor unit of the air-conditioning apparatus of claim 1, wherein the protrusion is formed integrally with a recess formed at a portion of a front face of the front panel.

* * * * *